US006173710B1

(12) United States Patent
Gibson et al.

(10) Patent No.: US 6,173,710 B1
(45) Date of Patent: Jan. 16, 2001

(54) VENTILATION SYSTEMS

(75) Inventors: Phillip George Gibson, West Malling; Martin Graeme Smith, Maidstone, both of (GB)

(73) Assignee: Vent Master (Europe) Limited, Kent (GB)

( * ) Notice: Under 35 U.S.C. 154(b), the term of this patent shall be extended for 0 days.

(21) Appl. No.: 09/355,998

(22) PCT Filed: Mar. 2, 1998

(86) PCT No.: PCT/GB98/00647

§ 371 Date: Nov. 22, 1999

§ 102(e) Date: Nov. 22, 1999

(87) PCT Pub. No.: WO98/38462

PCT Pub. Date: Sep. 3, 1998

(30) Foreign Application Priority Data

Feb. 28, 1997 (GB) ..... 9704250

(51) Int. Cl.[7] ..... F24C 15/20

(52) U.S. Cl. ..... 126/299 R; 126/299 D

(58) Field of Search ..... 126/299 R, 299 D, 126/21 R, 299 C; 55/DIG. 36; 454/66, 252, 49, 67, 58, 60, 52, 51

(56) References Cited

U.S. PATENT DOCUMENTS

| | | | | |
|---|---|---|---|---|
| 3,411,428 | * | 11/1968 | Ahlrich | 126/299 D |
| 3,583,306 | * | 6/1971 | Hagdorn | 126/299 D |
| 4,011,802 | * | 3/1977 | Molitor et al. | 126/299 D |
| 4,450,756 | | 5/1984 | Kling . | |
| 5,312,296 | * | 5/1994 | Aalto et al. | 126/299 R |

FOREIGN PATENT DOCUMENTS

| | | | | |
|---|---|---|---|---|
| 1 679 545 | | 3/1971 | (DE) . | |
| 0 118 570 | | 9/1984 | (EP) . | |
| 1535989 | * | 7/1968 | (FR) | 126/299 D |
| 2 132 335 | | 7/1984 | (GB) . | |
| 63-251740 | * | 10/1988 | (JP) | 126/299 D |

* cited by examiner

*Primary Examiner*—James C. Yeung
(74) *Attorney, Agent, or Firm*—Bacon & Thomas, PLLC

(57) ABSTRACT

A ventilation system for a kitchen comprises air extraction means (4) arranged above a kitchen appliance (102) such as an oven or the like. An air distribution means (6) arranged to form a downwardly flowing curtain air (62) outwardly of the air extraction means (4).

9 Claims, 4 Drawing Sheets

VENTILATION SYSTEMS

BACKGROUND OF THE INVENTION

1. Field of the Invention

This invention relates to ventilation systems and particularly but not exclusively to ventilation systems for commercial kitchens.

2. Related Art

Ventilation systems are usually required in commercial kitchens to remove smoke, smells and other unwanted airborne or gaseous substances. Typical systems comprise an extractor fan, the inlet to which is located as close as possible to the source of the smoke etc. in an attempt to prevent it from coming into contact with staff working in the kitchen, and an air supply to replace the extracted air with fresh air. A large canopy is provided above the appliance or appliances which are a potential source of smoke etc. Air and smoke etc. is removed from the canopy via an outlet provided at an upper region of the canopy. Such canopies should ideally be as large as possible in order to maximise the capture of the smoke etc. which may drift not only upwards, but also sideways. The canopy therefore takes up a large space, which is particularly inconvenient in smaller kitchens. Furthermore restrictions are placed on the minimum height of the lower edge of the canopy above the floor, in order to provide adequate headroom for staff and this means that, particularly where a kitchen has a low ceiling, the canopy is restricted as to how deep it may be and therefore how effectively it may capture the smoke.

With the known ventilation systems, in order to obtain adequate smoke extraction it is generally necessary to employ large and noisy extractor fans. These consume a lot of power and require correspondingly large ducting which is bulky and can be difficult to accommodate where space is restricted. Even with large canopies and high air extraction rates, known ventilation systems are not completely effective in removing smoke etc. from the kitchen.

SUMMARY OF THE DISCLOSURE

According to the present invention there is provided a ventilation system for a kitchen, comprising air extraction means to be arranged generally above a kitchen appliance and air distribution means arranged to form a downwardly flowing air curtain outwardly of the air extraction means.

With such a ventilation system, the rate at which air is extracted may be significantly reduced since the air curtain actively re-directs the air towards the air extraction means rather than simply containing it. Any smoke that does not enter the extraction means and is moving outwardly away from the extraction means, will impinge upon the air curtain. The outer edge of a body of such smoke, which is moving towards the air curtain, will thus be given a downward component of movement with respect to its inner edge, causing it to curl so that it starts to move inwardly towards the extraction means. Thus, less air needs to be extracted to achieve the desired removal of smoke. Such a reduction in air extraction confers significant benefits by requiring smaller fans, which therefore make less noise, consume less power and require less bulky ducting which makes them easier and cheaper to install.

For example, in a particular kitchen, which would have required an extraction rate of approximately 142–170 $m^3$/min (5000–6000 cu.ft/min) with a conventional system, it was found that when using a preferred embodiment of the present invention, an extraction rate of only approximately 74 $m^3$/min (2600 cu.ft/min) was needed to achieve acceptable smoke removal.

The advantages of providing a ventilation system with an air curtain may be realised if a canopy is also provided to contain smoke etc. Preferably however, no canopy is used since it is no longer necessary in order to produce satisfactory results. Without a canopy, much less space in the kitchen is taken up by the ventilation system.

Whilst the air distribution means could be arranged level with or below the air extraction means, preferably the air distribution means is arranged at a level above the level of the air extraction means. Therefore the air extraction means may be located at a relatively low level, close to the source of smoke etc., for example substantially vertically adjacent a kitchen appliance e.g. an oven. The proximity of the air extraction means to the kitchen appliance makes the air extraction means even more effective, further enabling the extraction rate to be reduced. The air distribution means can be at a higher level, providing sufficient headroom for staff, whilst still being effective to form the air curtain. This is to be contrasted with known systems in which a canopy extends downwardly to the same level as, or below, the air extraction means. In such a known system, therefore, the headroom requirement for the canopy determines the lowest position for the air extraction means and thus limits the effectiveness of smoke removal.

It may be possible for the air distribution means to direct air horizontally outwardly in such a way that a downwardly flowing air curtain is subsequently formed. Preferably, the air distribution means is arranged to direct air at least partially downwardly and most preferably it directs air both downwardly and outwardly, for example at approximately 45° to the vertical. Such arrangements have been found to be highly effective in re-directing air to the air extraction means when it is drifting away from it.

The air extraction means could be arranged as a plurality of discrete inlets. Preferably, the air extraction means comprises air inlet means following a defined path, as viewed in plan, and the air distribution means comprises air outlet means also following a defined path, as viewed in plan, the path of the air outlet means being substantially similar in shape to the path of the air inlet means. With this arrangement, an air curtain may be provided which corresponds in shape to-the air extraction means. For example, the air curtain in combination with physical barriers such as kitchen walls or partitions can effectively surround the air inlet means of the air extraction means. Such an arrangement is the most effective way of ensuring that any smoke moving away from the air extraction means is re-directed towards it.

The air inlet means and air outlet means could follow any suitable paths, depending upon the application to which the system is put e.g. linear paths is for use with a line of cooking appliances along one wall of a kitchen, or even circular paths respectively above and around an appliance in the middle of a kitchen. Preferably though, the air inlet path and the air outlet path are substantially U-shaped. This is a particularly convenient arrangement for example for use above a commercial free-standing oven such as a pizza oven, since respective opposite portions (the limbs of the "U") of the air inlet means may be associated with the entry and exit points to the oven and a further portion (the base of the "U") may be associated with the outer facing side of the oven. The fourth side can be blocked e.g. by a wall or backplate.

The air distribution means may be configured in any suitable arrangement to distribute the air, but preferably comprises a plenum chamber which is divided into sub-chambers by vertically extending walls in order to maintain a substantially equal air flow along the length of the air curtain. In arrangements where the air outlet means has discrete portions (e.g. the two limbs and the base of a "U" shape), then a sub-chamber may be associated with each such air outlet portion, with the plenum chamber being divided according to the lengh of the air outlet portions to maintain a desired distribution of air flow to the respective portions. This is advantageous in ensuring that whatever lateral direction smoke emanates from a kitchen appliance, then it will inevitably encounter an effective air curtain to re-direct it towards the air extraction means.

The air curtain provided by the present invention may also have a beneficial cooling effect for those working in its vicinity in the kitchen. However, in a preferred embodiment, the ventilation system further comprises at least one controllable air outlet arranged to deliver air outwardly of the air curtain, so as not to interfere therewith. Such air outlets, if provided, are beneficial to staff working in the vicinity as they may have a pleasant cooling effect. However, the rate of flow of air through such outlets is sufficiently low as not to affect the flow of air forming the air curtain. Such air outlets are arranged so that they cannot be directed towards the air curtain and therefore cannot interfere with its operation.

In a preferred embodiment, the ventilation system further comprises means to distribute air from below the air extraction means to cause a generally upward flow of air towards the air extraction means. By providing a low-down source of air, which is moving upwardly, a general upward movement of air and smoke in the region of the kitchen appliance is enhanced and therefore the effectiveness of the air extraction means is further improved.

DESCRIPTION OF THE DRAWINGS

A preferred embodiment of the present invention will now be described, by way of example only, with reference to the accompanying drawings in which.

DETAILED DESCRIPTION

Figure 1:
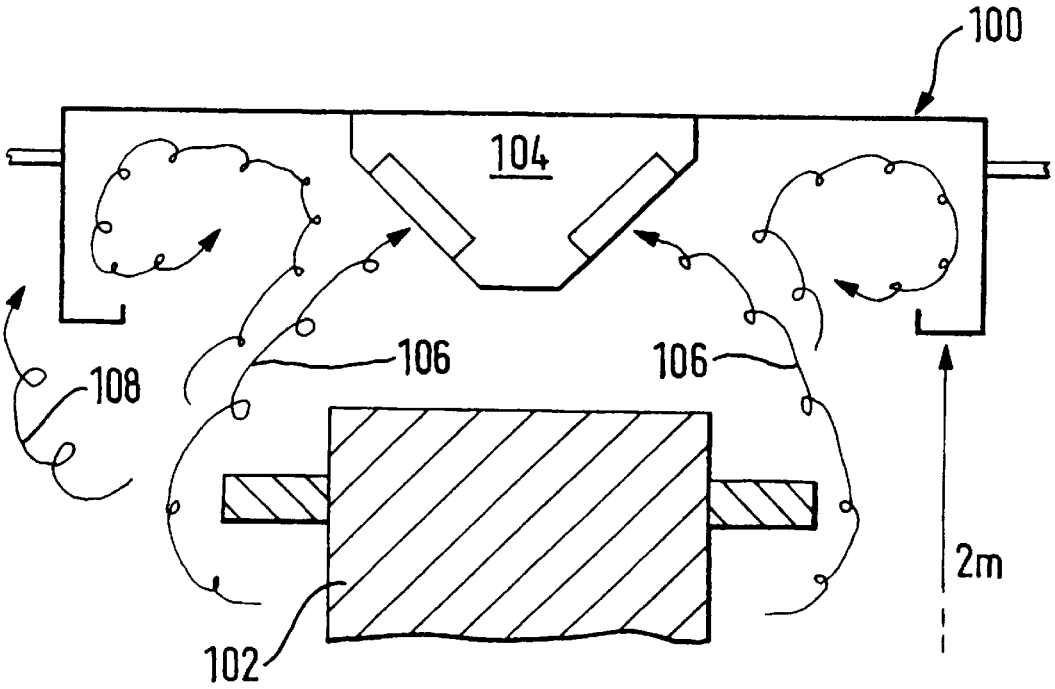
FIG. 1 PRIOR ART
FIG. 1 is a schematic side view of a conventional extraction canopy above a free standing oven.
Figure 2:
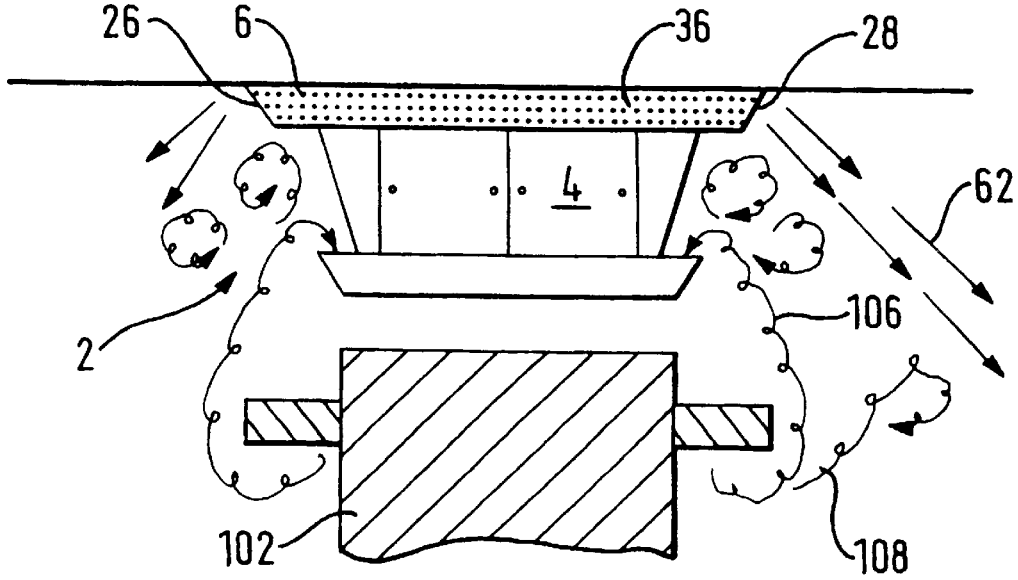
FIG. 2 is a schematic side view of an embodiment of the present invention for use with the same oven.

Firstly a general distinction between the prior art and the present invention will be drawn with reference to FIGS. 1 and 2. In FIG. 1 a conventional canopy 100 is shown above an oven 102. An extractor unit 104 is provided inside the canopy to extract smoke 106 from the oven. Despite the large size of the canopy 100 compared to the size of the oven 102, it is still possible for stray smoke 108 to avoid extraction by drifting outside the canopy. Air in the room is replenished with such a system by a simple outlet which may be placed anywhere in the room.

Turning now to FIG. 2, a ventilation system in accordance with the present invention is denoted generally by the reference numeral 2. The ventilation system 2 is arranged generally above an oven 102. The ventilation system 2 comprises air extraction means 4 arranged below an air distribution means 6. Some smoke 106 either enters the air extraction means 4 directly from the oven 102. Other smoke 108, drifts off sideways but is captured and re-directed towards the air extraction means by air blown outwardly and downwardly from the air distribution means 6.

The preferred embodiment will now be described in greater detail with reference to FIGS. 3 to 5. The extraction means 4 and air distribution means 6 are mounted to a back plate 80 and to the ceiling of the kitchen. The back plate 80 may be pushed against a wall or the unit may be a free standing 'island'. The oven 102 is connected to services such as gas and electricity hidden inside the backplate 80 by means of flexible pipes to allow the oven 102 to be moved away from the backplate 80 for cleaning. The oven 102 is shown with its lower part cut away in order to show the position of the lower air vent 60 which is provided near the bottom of the backplate 80. A duct running inside the backplate supplies this vent 60 with air from the air distribution means 6.

The air distribution means has air outlet means having portions 26,28,36 around three sides of a rectangle to correspond to the air inlets 82,84,86 of the air extraction means 4. So called Punkah louvres 50, 52 are provided at the ends of the air outlet portions 26,28 respectively to provide a controllable source of cooling air for the benefit of people working in the vicinity of the oven, but their angle of tilt is restricted in the downward direction to prevent this cooling air from interfering with air coming from the air outlet portions 26,28,36.

Figure 4:
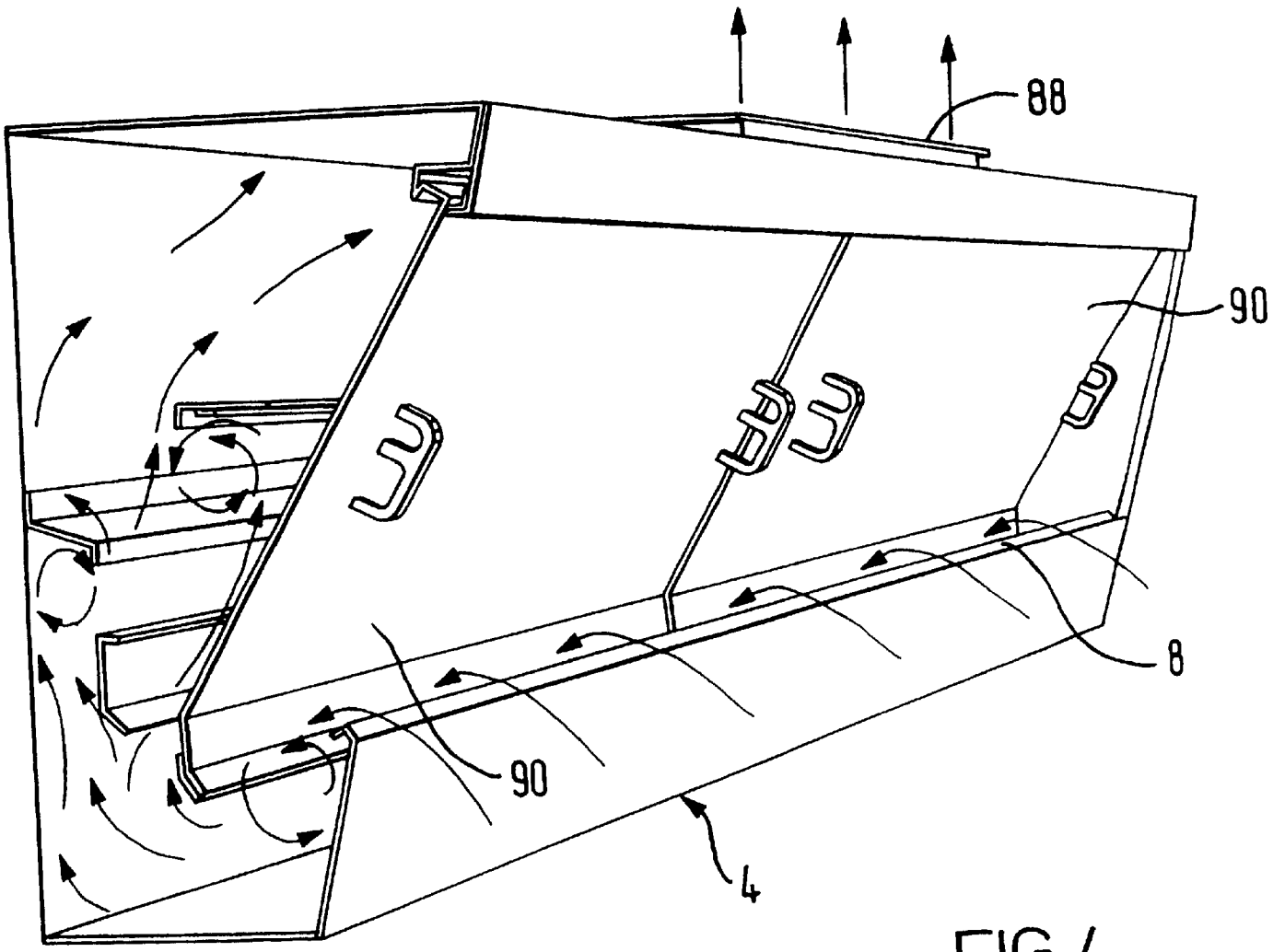
FIG. 4 is a perspective view of part of the extraction means used in the embodiment of FIG. 3.

Part of the air extraction means 4 is shown in greater detail in FIG. 4. Any suitable extractor unit may be used and the one shown for use in this embodiment is a "Cyclo Maze Dry" (trade mark) extractor unit manufactured by Vent Master. Smoke etc. enters the unit through the air inlet 84. The air is then extracted to the outside through the extract duct 88. Doors 90 are provided on the unit to allow its interior to be accessed for cleaning.

Figure 5:
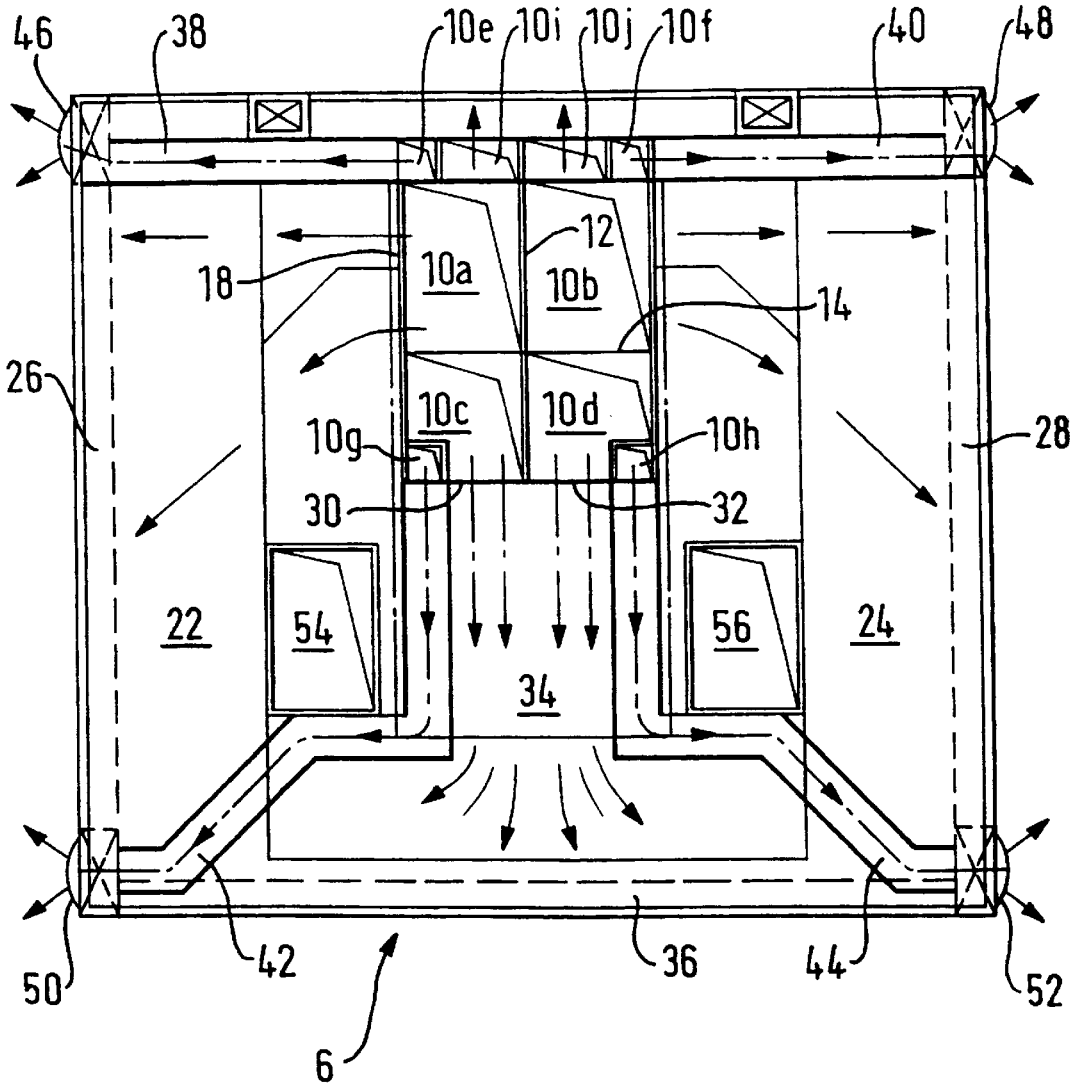
FIG. 5 is a horizontal cross section through a plenum chamber of an air distribution means in accordance with the present invention.

A cross section through the air distribution means 6 is shown, looking upwardly, in FIG. 5. A main plenum chamber 10 communicates with a source of fresh air via a fan (not shown) and is defined by walls extending vertically between the top and bottom of the air distribution means 6. The chamber 10 is further divided into four main sub-chambers 10*a*, 10*b*, 10*c* and 10*d* by walls 12,14 and a number of smaller sub-chambers 10*e*–10*j*. The sides 18,20 of the chambers 10*a*, 10*b* respectively are open so as to allow air to exit sideways therefrom into further chambers 22 and 24 respectively. These chambers 22,24 open into respective air outlet portions 26,28 of the air outlet means in such a way that air exits evenly along the whole of the length of-each outlet portion 26,28. Chambers 10*c* and 10*d* have their front sides 30,32 open so as to allow air to exit into a chamber 34. This chamber 34 is open to the front air outlet portion 36.

Sub-chambers 10*e*, 10*f*, 10*g*, 10*h* communicate air from the air inlet duct with horizontal channels 38,40, 42,44 respectively to the Punkah louvres 46,48,50,52 respectively which are arranged at the corners of the air distribution means 6. It will be seen that the combined cross-sectional area of the four chambers 10*e*, 10*f*, 10*g*, 10*h* is relatively small compared to the area of the rest of the chamber 10. Consequently, even if all four Punkah louvres are opened simultaneously, the reduction in air flow through the air outlet portions 26,28,36 will be insignificant. The angle through which the Punkah louvres may be moved is restricted so that air exiting therefrom cannot interfere with air exiting from the air outlet portions 26,28,36.

Sub-chambers 10*i* and 10*j* extend downwardly into channels which direct air down (ie. out of the plane of the paper) towards an outlet 60 (see FIG. 3) near the base of the oven 102.

Extraction ducts 54 and 56 pass through the plenum chamber without fluidly communicating therewith to convey the air extracted through the extraction means 4 to the outside.

Operation of the ventilation system will now be described. Smoke etc. 106 from the oven 102 will mostly drift approximately vertically upwards, assisted by the upwardly moving air coming out of the lower outlet 60 (FIG. 3). The smoke 106 will thus enter the air extraction means through the air inlets 82,84,86 and be extracted to the outside. However, smoke 108 which is drifting further sideways will encounter the downwardly moving air from the air outlet portions 26,28,36 which forms an air curtain 62. As a body of smoke 108 impinges upon the downwardly moving-air 62, its outer edge will-be given a downward component of velocity with respect to its inner edge. In the example of the smoke on the right hand side as seen in FIG. 3, this will cause the body of air 108 to curl in a clockwise direction inwardly, ie. towards the air inlet portion 82,84,86 of the air extraction means. Thus, all the smoke should eventually end up entering the inlet portion. Air from the air curtain 62 and vent 60 mostly replenishes the air extracted by the air extraction means 4 although may not do so entirely as it may be desirable to maintain a slightly lower pressure in the kitchen, e.g. where it is attached to a dining room, to offer further prevention of unwanted smoke or smells reaching the dining room.

Figure 3:
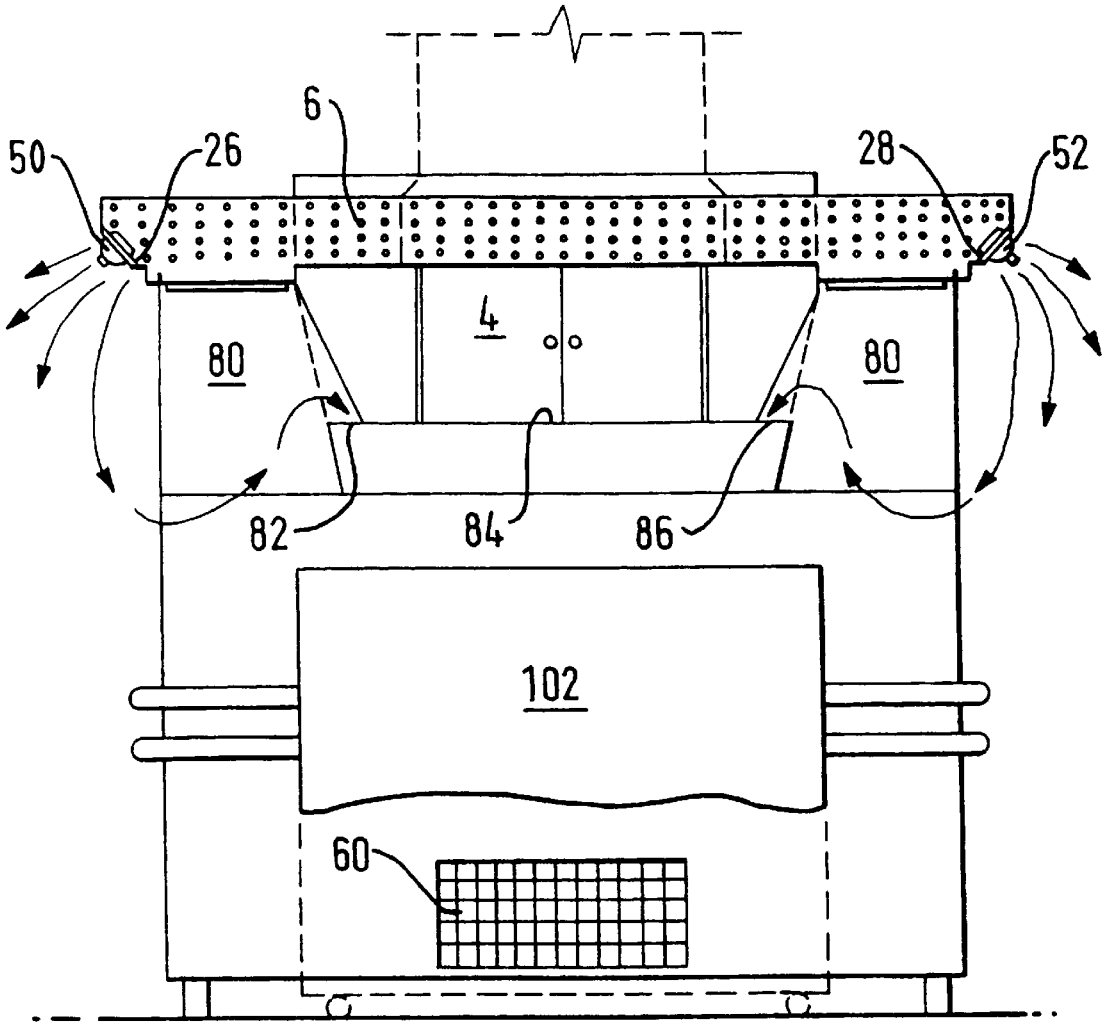
FIG. 3 is a front view of a ventilation system for a kitchen in accordance with the present invention.

As may be seen from FIGS. 2 and 3, although the air extraction means 4 extends a significant way down from the ceiling, it covers a relatively small surface area, not extending beyond the normally wasted area above the oven. The air distribution means 6 is a little larger in area but is very shallow in the vertical direction and therefore does not materially interfere with space in the kitchen. Since the air is directed both downwardly and outwardly, the air curtain 62 covers a wider plan area as it extends downwardly, advantageously capturing smoke over a wider area than that of the air distribution means 6.

In an example of the operation of the above-described preferred embodiment, air is supplied via the air outlet portions 26,28,36 at a rate of 0.8 $m^3$/second, via the vent 60 at a rate of 0.2 $m^3$/second and air is extracted via the air inlets 82,84,86 at a rate of 1.23 $m^3$/second.

It will be understood by those skilled in the art that although a specific embodiment of the present invention has been shown and described herein, certain modifications may be made without departing from the scope of the invention as defined by the appended claims. For example, the system need not be arranged around three sides of a rectangle above a pizza oven but could instead extend horizontally in a straight line above a range of cooking appliances along a single wall of a kitchen. Furthermore, the air outlet means and air inlet means need not be restricted to having straight sections and indeed it may be preferable in some applications for them to be curved or even circular.

What is claimed is:

1. A ventilation system for a kitchen, comprising:

an air extractor disposed at a first level above a kitchen appliance; and an air distributor disposed at a second level, said second level being significantly above said first level and arranged to direct air so as to form a downwardly flowing air curtain outwardly of said air extractor for redirecting laterally outwardly flowing contaminated air moving towards the downwardly flowing air curtain.

2. A ventilation system as claimed in claim 1, wherein said ventilation system does not have a canopy arranged outwardly of the air extractor.

3. A ventilation system as claimed in claim 1, wherein said air distributor is arranged to direct air at least partially downwardly.

4. A ventilation system as claimed in claim 3, wherein said air distributor is arranged to direct air both downwardly and outwardly.

5. A ventilation system as claimed in claim 1, wherein the air extractor comprises an air inlet following a first defined path having a first shape, as viewed in plan, and wherein the air distributor comprises an air outlet following a second defined path having a second shape, as viewed in plan, said first shape being substantially similar to said second shape and said first path being arranged outwardly of the second path.

6. A ventilation system as claimed in claim 5, wherein the first path and the second path are substantially U-shaped.

7. A ventilation system as claimed in claim 1, wherein said air distributor comprises a plenum chamber divided into sub-chambers by vertically extending walls in such a way as to maintain a substantially equal air flow along the whole length of the air curtain.

8. A ventilation system as claimed in claim 1, further comprising a lower air distributor located so as to distribute air from below the air extractor to cause a generally upward flow of air towards said air extractor.

9. A ventilation system as claimed in claim 1, further comprising at least one controllable air outlet arranged so as to deliver air outwardly of said air which is directed outwardly of the air extractor, so as not to interfere therewith.

* * * * *